United States Patent [19]

Belvederi

[11] Patent Number: 4,945,927

[45] Date of Patent: Aug. 7, 1990

[54] CONTINUOUS CIGARETTE ROD MANUFACTURING MACHINE

[75] Inventor: Bruno Belvederi, S. Martino Di Monte S. Pietro, Italy

[73] Assignee: G.D. Societa' Per Azioni, Bologna, Italy

[21] Appl. No.: 62,458

[22] Filed: Jun. 16, 1987

[30] Foreign Application Priority Data

Jun. 25, 1986 [IT] Italy ..... 3448 A/86

[51] Int. Cl.[5] ..... A24C 5/14; A24C 5/20; A24C 5/31

[52] U.S. Cl. ..... 131/84.1; 131/84.3; 131/904; 131/906

[58] Field of Search ..... 131/84.3, 84.1, 404, 131/906

[56] References Cited

U.S. PATENT DOCUMENTS 4,616,662 10/1986 Hartmann et al. ..... 131/84.3

*Primary Examiner*—V. Millin

*Attorney, Agent, or Firm*—Marshall, O'Toole, Gerstein, Murray & Bicknell

[57] ABSTRACT

On a continuous cigarette rod manufacturing machine the paper strip enveloping the rod is fed by the combined action of a conveyor, for forming the rod, and a layer of tobacco fed by a suction conveyor from a supply duct into a loading position on the paper strip; means being provided for detecting any variation in the flow of tobacco on the suction conveyor, which means, in the event of clogging, activate retaining and guide means designed to prevent swerving or tearing of the paper strip.

8 Claims, 2 Drawing Sheets

CONTINUOUS CIGARETTE ROD MANUFACTURING MACHINE

BACKGROUND OF THE INVENTION

The present invention relates to a continuous cigarette rod manufacturing machine.

Known cigarette manufacturing machines of the aforementioned type feature a substantially vertical duct supplied at the bottom with a continuous flow of tobacco particles, and closed off at the top by the bottom branch of a suction conveyor on which a layer of tobacco is formed. The said layer of tobacco is then transferred by the said conveyor into a position outside the said vertical duct and over a horizontal surface or bed for forming the said continuous cigarette rod.

In the said latter position, the layer of tobacco is fed on to a strip of cigarette paper travelling along the said forming bed, via the interposition of the top branch of a belt in the form of a loop and made of textile material permeable by air.

The paper strip is wound off a reel and, prior to utilization, is first fed through a number of operating units, which may include, for example, a splicing device, one or more printing devices, and various control devices. Guiding of the paper strip and textile belt on the forming bed is performed by a single pulley.

As the paper strip travels along the said forming bed, the textile belt causes it to fold gradually crosswise, so as to form a continuous tobacco-filled cylinder commonly known as a continuous cigarette rod, which is subsequently cut into single cigarettes.

The poor efficiency of machines of the aforementioned type is due to the work involved in threading the paper strip along a route which, as already seen, is both long and complicated.

This is done manually by the operator at the start of each shift, or whenever the paper strip tears, and is even more complicated in the case of dual-rod machines, i.e. for simultaneously producing two continuous cigarette rods. U.S. Pat. No. 4,336,813 filed by the present Applicant, G. D. S.p.A., proposes a solution to the problem by partly automating threading of the paper strip along the said route.

According to the said patent, the cylindrical surface of the guide pulley at the input to the rod forming bed is connected to a suction source. Consequently, all the operator has to do is place the end of the paper strip, or strips, in the case of a dual-rod machine, next to the guide pulley, which sucks the strip on to its outer surface and, as it turns, feeds it on to the rod forming bed. Once the machine has been started up, the guide pulley is disconnected from the suction source, and the paper strip is fed along the forming bed by the combined action of the textile belt and the tobacco layer alone.

In the light of U.S. Pat. No. 4,336,813, the operator is still required, in the event of the paper strip tearing, to thread it through the various operating units already mentioned. As, during normal operation of the machine, the paper strip is fed forward by the combined action of the textile belt on its underside and the tobacco layer on its top side, any shortage or substantial variation in the flow of tobacco on the strip results, firstly, in swerving and, eventually, in tearing of the paper strip.

This is tantamount to saying that a shortage in tobacco supply and, particularly, clogging inside the suction duct or elsewhere on the machine, are indirectly responsible for tearing of the paper strip.

In the event of this happening, in addition to clearing the clogged section, the operator is also called upon to perform the painstaking job of threading the paper strip through the operating units already mentioned, so as to bring the end of the strip into contact with the guide pulley at the input of the rod forming bed.

SUMMARY OF THE INVENTION

The aim of the present invention is to provide a cigarette manufacturing machine designed to overcome the aforementioned drawbacks associated with the present state of the art, i.e. a machine whereby a shortage in the supply of tobacco to the rod forming bed does not necessarily result in tearing of the paper strip.

With this aim in view, according to the present invention, there is provided a continuous cigarette rod manufacturing machine for producing at least one continuous cigarette rod; said machine comprising, for each said rod, a shreded tobacco supply duct having a top outlet; a bed for forming the said rod; means for feeding a continuous paper strip along the said rod forming bed; and a suction conveyor extending over the said outlet so as to enable the formation, on the suction conveyor itself, of a continuous layer of tobacco particles, and for feeding the said layer to the said rod forming bed and on to the said paper strip; characterised by the fact that it also comprises means for detecting any variation in the flow of tobacco along the said suction conveyor, in relation to a given flow value; and means for retaining and guiding the said paper strip, said means being connected to the said detecting means and being designed to positively engage the said paper strip subsequent to the said variation in flow.

BRIEF DESCRIPTION OF THE DRAWINGS

The present invention will be described, by way of a non-limiting example, with reference to the accompanying drawings, in which.

DETAILED DESCRIPTION OF THE INVENTION

Figure 1:
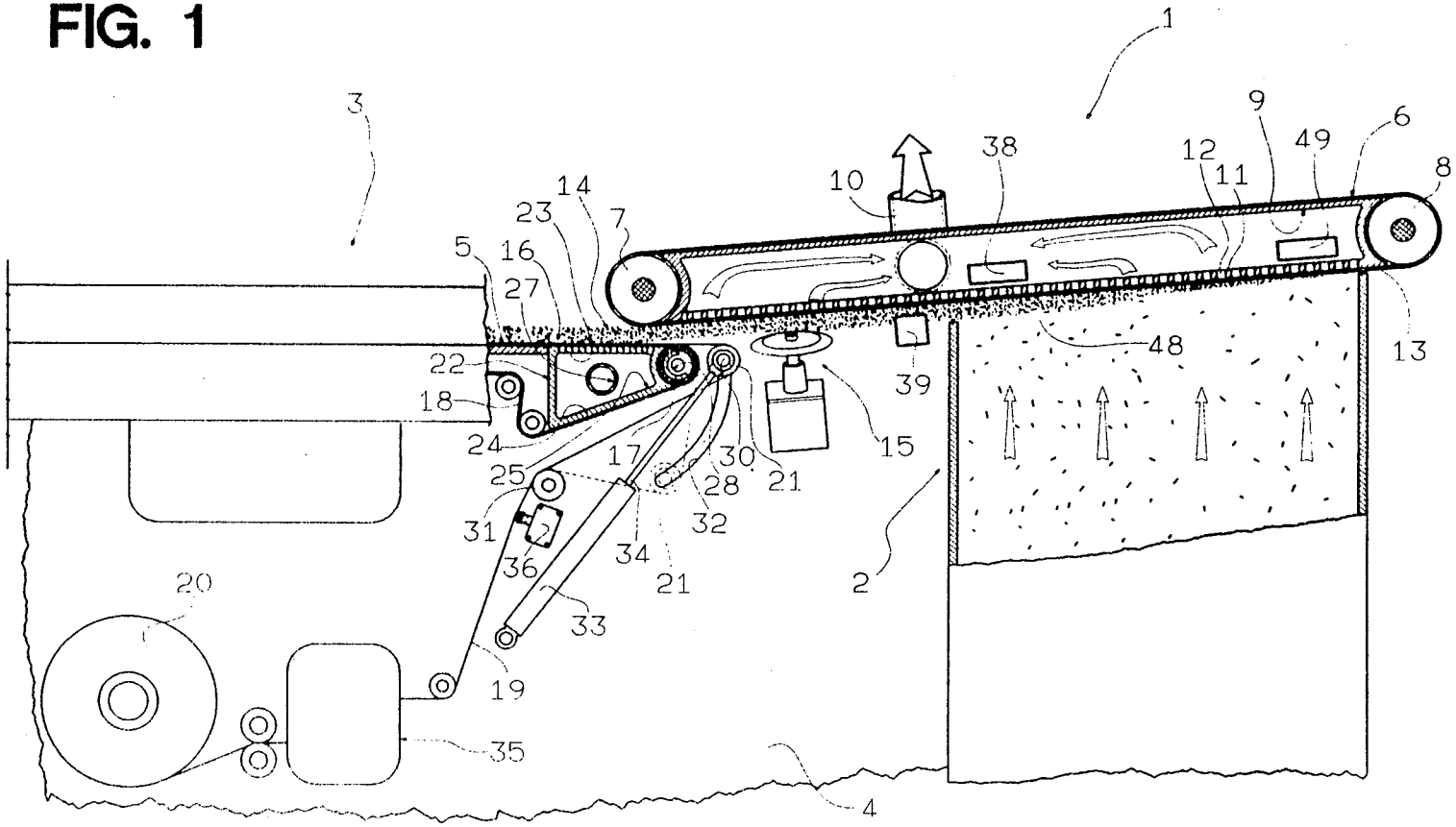
FIG. 1 shows a schematic front view of a cigarette manufacturing machine in accordance with the teachings of the present invention.

Number 1 in FIG. 1 indicates a continuous cigarette rod manufacturing machine.

Machine 1 is divided into two parts, i.e. a substantially vertical duct 2, and a section 3 comprising a base 4 defined at the top by a surface or rod forming bed 5.

Duct 2 and section 3 are located beneath and connected together by a suction conveyor belt 6 looped about clockwise-rotating end rollers 7 and 8.

Inside the loop defined by belt 6, there is provided a chamber 9 connected, via duct 10, to a suction source (not shown), and defined at the bottom by a wall 11 having through holes 12.

The bottom branch 13 of belt 6, running over wall 11 and in contact with the same, closes off the outlet of duct 2 and presents its left end extending up to a position 14, herein referred to as the loading position, wherein tobacco is fed to section 3.

Next to branch 13, outside duct 2 and upstream from loading position 14, provision is made for a device 15 herein referred to as a shaving device.

Loading position 14 is located at the confluence of branch 13 and the top branch 16, guided on to bed 5 by input pulley 17, of a textile conveyor belt 18 looped about anticlockwise-rotating pulleys.

Number 19 indicates a strip of cigarette paper wound off a reel 20 and guided, by a roller 21 beside pulley 17, on to branch 16 of belt 18.

Beside input pulley 17, there is provided a box 22 defined, at the top, by a pierced horizontal suction wall 23 adhering to branch 16, and, at the bottom, by a sloping wall 24 arranged contacting the portion of belt 18 immediately preceding pulley 17.

Figure 3:
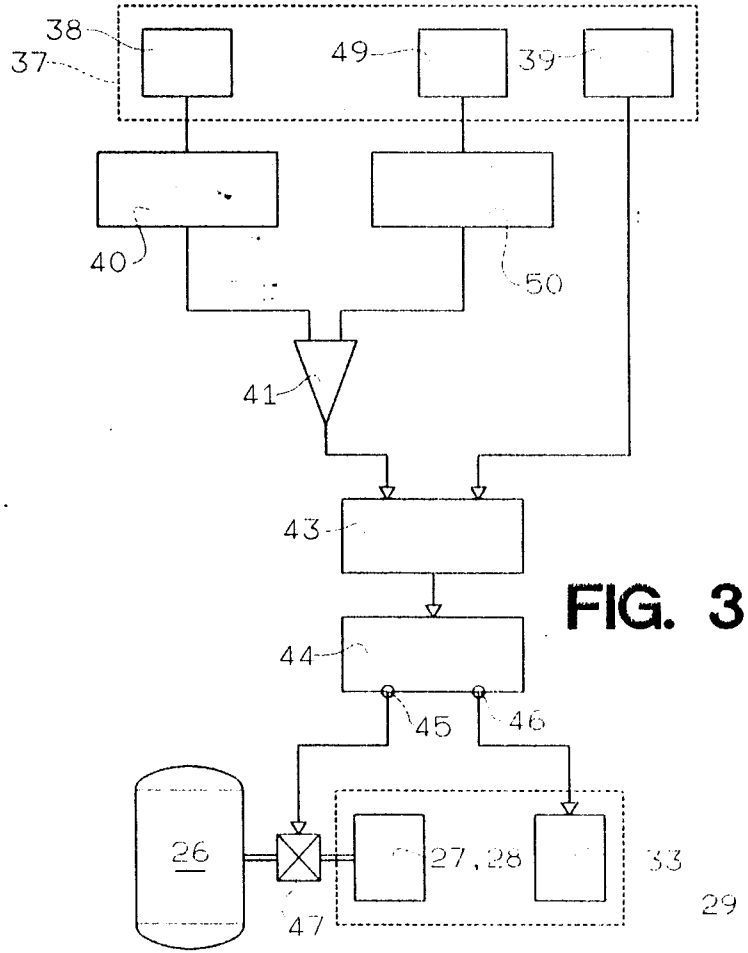
FIGS. 2 and 3 show two block diagrams of control circuits forming part of the machine according to the present invention.
Figure 2:
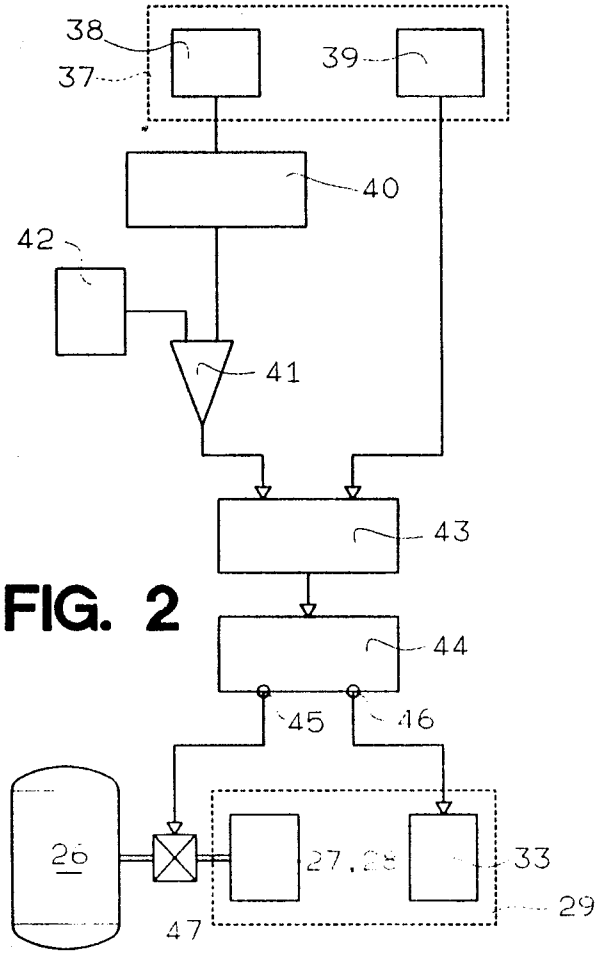

Box 22 defines a chamber 25 communicating with a suction source 26 via a duct 27 (also shown in FIGS. 2 and 3).

Input pulley 17, which is hollow and presents a number of equally-spaced radial holes, is connected to suction source 26 via axial duct 28.

The said guide roller 21, for guiding paper strip 19 and substantially tangent with the plane of branch 16, is mounted in rotary manner on a shaft 30 parallel with the axis of pulley 17.

Below box 22, there are provided fixed guide means comprising a roller 31 mounted on a shaft parallel with shaft 30.

Shaft 30 is fitted through the top end of an arched slot 32 formed in the front wall of base 4. Number 33 indicates an activating means or actuator designed, via output shaft 34, to slide roller 21 along the path defined by slot 32. Pulley 17, box 22 with respective suction wall 23 and mobile roller 21 constitute means 29 for retaining and guiding strip 19 on forming bed 5.

After travelling through various operating units, indicated schematically by block 35, and control device 36, cigarette paper strip 19 wound off reel 20 is fed on to rod forming bed 5 via rollers 31 and 21.

With special reference to the diagram in FIG. 2, number 37 indicates a control device for detecting any variation in the flow of tobacco supplied to rod forming bed 5.

The said device 37 may consist of a pressure detector 38 located inside chamber 9 or at the top end of duct 2. Alternatively, or in addition to detector 38, device 37 may comprise a detector 39 for detecting the thickness of the tobacco layer sucked on to conveyor belt 6.

The output of detector 38 is connected, via amplifier 40, to a first input of a comparator 41, the second input of which is connected to a threshold signal generator indicated schematically by block 42.

Comparator 41 and detector 39 are connected to the two inputs of a delay block 43 connected to an amplifier 44 having two outputs 45 and 46.

Output 45 is connected to an activating means consisting of an electrovalve 47 located between suction source 26 and ducts 27 and 28; output 46 is connected to the control input of actuator 33.

During operation of manufacturing machine 1, known means (not shown) provide for feeding a continuous flow of tobacco particles to the bottom end of duct 2.

By virtue of an ascending air current generated by a compressed air source (not shown), the said particles are blown up duct 2 and collect on branch 13 so as to form a continuous tobacco layer 48 of substantially uniform thickness.

Upon leaving duct 2, tobacco layer 48 clinging to suction belt 6 is first fed through shaving device 15 for evening off the thickness of the layer, after which, it is fed, in the said loading position 14, on to rod forming bed 5 where it is wrapped, in known manner, inside paper strip 19.

The continuous cigarette rod so formed is then cut into cigarette lengths by a cutting device not shown.

For starting up section 3, suction source 26 is connected, either manually or automatically, to duct 27 inside box 22, and to duct 28 of pulley 17, while manual or automatic means provide for setting roller 21 to its bottom limit position.

The operator then threads paper strip 19 through the said operating units 35 and past guide rollers 31 and 21 until the end of strip 19 contacts pulley 17, which feeds the said end through pierced wall 23 and on to forming bed 5.

As soon as tobacco layer 48 moves past loading position 14, suction source 26 is disconnected from ducts 27 and 28, in that, as already stated, under normal operating conditions, paper strip 19 is fed forward by virtue of the combined action of conveyor belt 18 and tobacco layer 48 itself.

Once normal operation is assumed, actuator 33 moves roller 21 into its top limit position. As described in Italian Patent Application No. 3370A/85 filed by the present Applicant, such an arrangement enables the crosswise position of strip 19 to be adjusted easily via known adjusting means located upstream from pulley 17.

Now let us assume detector 38 supplies an output signal indicating a variation in the flow of tobacco on suction conveyor 6.

If the said signal is higher than the reference signal in block 42 and longer than the reference value in delay block 43, amplifier 44 emits two control signals at outputs 45 and 46. The first of the said signals opens electrovalve 47 so as to connect suction source 26 to ducts 27 and 28, whereas the second signal, via actuator 33, causes roller 21 to move down to the bottom end of slot 32.

The same applies if detector 39 emits a signal indicating too shallow a layer 48 lasting longer than the reference value in delay block 43.

Consequently, in the event of the tobacco supply to loading position 14 being cut off, i.e. in the absence of one of the factors determining forward feeding of paper strip 19, the latter is held by suction by pulley 17 and wall 23 of box 22, which prevent it from swerving from side to side or tearing.

It should be noted that, when roller 21 is set to its bottom limit position, strip 19 also moves from a position wherein it is substantially tangent with pulley 17, to a position wherein it is wound substantially 45° about the said pulley 17, thus improving its stability in response to transverse strain.

Control device 37 provides for stopping machine 1 in a manner not shown. For the machine to be started up again, the operator need simply remove the causes responsible for the tobacco becoming clogged.

Unlike the present state of the art, therefore, no painstaking work is required involving paper strip 19, which is held in the correct operating position by virtue of pulley 17 and wall 23.

According to a variation shown in FIG. 3, pressure detector 38 operates in conjunction with a further pressure detector 49 located inside chamber 9 and connected to comparator 41 via amplifier 50.

In this case, the output signal from comparator 41 is no longer determined by comparing the signal supplied by detector 38 with a fixed reference signal in block 42, but rather, by the difference in the pressures picked up by detectors 38 and 39 at two different points inside chamber 9.

In the case of a dual-rod manufacturing machine, both ducts 2 on the machine are assigned a respective control device 37.

On dual-rod machines, a clogging signal need only be supplied by one of control devices 37 for activating retaining and guide means 29 and actuator 33 relative to both paper strips 19.

Consequently, in the case of a dual-rod machine, retaining and guide means 29 and actuator 33 with respective roller 21 operate on both strips 19.

The location of the said retaining and guide means 29 may, of course, be other than as shown in FIG. 1. For example, according to a first variation (not shown), suction wall 23 is located at the output end of bed 5, and designed to cooperate with strip 19 already folded for wrapping the continuous cigarette rod.

The said retaining and guide means 29 may also differ in design from those described herein. For example, according to a further variation (not shown), they consist of a pair of counter-rotating rollers located at either end of bed 5 and connected to device 37 for gripping either strip 19 or the finished cigarette rod.

As already stated, device 37 and retaining and guide means 29 prevent strip 19 from tearing as a result of varying tobacco supply from branch 13 of conveyor belt 6. They also result, however, in the formation of an uneven rod portion when machine 1 is started up again.

To overcome this drawback, according to a further variation (not shown), device 37 is used to advantage for controlling a rod cutting and reject device as described in U.S. Pat. No. 4,461,415 filed by the present Applicant.

I claim:

1. A continuous cigarette rod manufacturing machine (1) for producing at least one continuous cigarette rod; said machine comprising, for each said rod, a shredded tobacco supply duct (2) having a top outlet; a bed (5) for forming the said rod; means (18) for feeding a continuous paper strip (19) along the said rod forming bed (5); and a suction conveyor (6) extending over the said outlet so as to enable the formation, on the suction conveyor (6) itself, of a continuous layer (48) of tobacco particles, and for feeding the said layer (48) to the said rod forming bed (5) and on to the said paper strip (19); characterised by the fact that it also comprises means (37) for detecting any variation in the flow of tobacco along the said suction conveyor (6), in relation to a given flow value; and means (29) for retaining and guiding the said paper strip (19), said means (29) being connected to the said detecting means (37) and being designed to positively engage the said paper strip (19) subsequent to the said variation in flow.

2. A machine as claimed in claim 1, characterised by the fact that the said detecting means (37) comprise means (38; 49) for detecting variations in the permeability of the assembly consisting of the said suction conveyor (6) and the said continuous layer (48) of tobacco particles.

3. A machine as claimed in claim 1, characterised by the fact that the said detecting means (37) comprise means (39) for detecting the thickness of the said continuous layer (48) of tobacco particles.

4. A machine as claimed in claim 1, characterised by the fact that the said retaining and guide means (29) are located at one end of the said forming bed (5); the said feeding means comprising a conveyor belt (18), and the said retaining and guide means (29) being designed to positively engage the said paper strip (19) so as to secure the said strip (19) transversely in relation to the said conveyor belt (18).

5. A machine as claimed in claim 4, characterised by the fact that the said retaining and guide means (29) are pneumatic.

6. A machine as claimed in claim 5, characterised by the fact that the said retaining and guide means (29) comprise a suction pulley (17) arranged, in use, contacting the said paper strip (19); a suction source (26); and connecting means for pneumatically connecting the said source (26) to the said pulley (17); the said connecting means comprising normally-closed valve means (47) connected to the said detecting means (37).

7. A machine as claimed in claim 6, characterised by the fact that the said retaining and guide means (29) comprise a roller (21) for guiding the said paper strip (19), and actuating means (33) connected to the said detecting means (37), for moving the said guide roller (21) between an idle and an operating position; the said guide roller (21), in use, maintaining the said paper strip (19) substantially tangent with the said suction pulley (17) when in the said idle position, and placing the said paper strip (19) contacting part of the perimeter of the said suction pulley (17) when in the said operating position.

8. A machine as claimed in claim 5, characterised by the fact that the said retaining and guide means (29) comprise a suction wall (23) cooperating, in use, with the said paper strip (19); a suction source (26); and connecting means for pneumatically connecting the said source (26) to the said suction wall (23); the said connecting means comprising normally-closed valve means (47) connected to the said detecting means (37).

* * * * *